United States Patent [19]

Tremmel

[11] 4,441,969

[45] Apr. 10, 1984

[54] COUMARIN PROCESS AND NICKEL ELECTROPLATING BATH

[75] Inventor: Robert A. Tremmel, Woodhaven, Mich.

[73] Assignee: OMI International Corporation, Warren, Mich.

[21] Appl. No.: 362,940

[22] Filed: Mar. 29, 1982

[51] Int. Cl.[3] ..... C25D 3/18

[52] U.S. Cl. ..... 204/49

[58] Field of Search ..... 204/49

[56] References Cited

FOREIGN PATENT DOCUMENTS 892904 4/1962 United Kingdom ..... 204/49

1182443 2/1970 United Kingdom ..... 204/49

*Primary Examiner*—M. J. Andrews

*Attorney, Agent, or Firm*—Richard P. Mueller

[57] ABSTRACT

A process and electroplating bath for use in electrodepositing nickel on a base where the electroplating bath includes a coumarin compound and an aryl hydroxy carboxylic acid compound, such as salicylic acid, present in a combined amount effective to provide a ductile, self-leveling nickel deposit. The bath may further include hexyne diol and/or a material selected from the group consisting of primary acetylenic alcohols and adducts of primary acetylenic alcohols, as well as mixtures thereof. It has been found that excellent leveling and physical properties can be maintained utilizing such a bath, while at the same time, the usual coumarin concentration level can be reduced significantly and process life can be dramatically extended. In addition, additives such as butyne diol, and/or aldehydes such as formaldehyde and chloral hydrate may be utilized. It has also been found that corrosion resistance is substantially improved utilizing the process and electroplating bath of the present invention.

36 Claims, No Drawings

COUMARIN PROCESS AND NICKEL ELECTROPLATING BATH

BACKGROUND OF THE INVENTION

This invention relates to an improved process and electroplating bath for the electrodeposition of metal, and more particularly to an improved process and electroplating bath for the formation of electrodeposits of nickel and nickel alloys.

The use of coumarin as an additive in nickel electroplating baths, especially semi-bright nickel processes, to produce ductile, lustrous deposits with excellent leveling is well known. It is further known that the degree of leveling obtained is generally proportional to the concentration of coumarin in the plating bath. Thus, a high concentration of coumarin gives the best leveling. But such characteristics are short-lived since such high coumarin concentrations also result in a high rate of formation of detrimental breakdown or degradation products. These degradation products are objectionable in that they can cause uneven, dull gray areas which are not readily brightened by a subsequent bright nickel deposit; they can reduce the leveling obtained from a given concentration of coumarin in the plating bath; and they can reduce the beneficial physical properties of the nickel electrodeposits.

As noted above, the fact that coumarin breaks down or degrades under many conditions is well known. In the operation of plating baths containing coumarin, it is therefore usually necessary to monitor such degradation so that plating is not adversely affected. One method commonly used to monitor the degradation of such plating baths is a test method known as the "TF Index", where "TF" stands for treatment factor. The "TF Index" is a measure of the amount of coumarin degradation products present in such baths. Normally, melilotic acid is a primary degradation product found in plating baths containing coumarin, although other degradents are also present in smaller quantities. In general, a "TF Index" of from about 0.5 to about 2 indicates a tolerable level of degradation products, whereas a "TF Index" of over about 5 would indicate that the plating bath was probably not operating as desired and that the physical properties and appearance of the resulting plated materials would be unsatisfactory. In extreme cases, e.g., where insoluble anodes are used, "TF Indexes" as low as 1.5 to 2.0 have been known to indicate deleterious effects on the subsequent deposits. At this point, a batch treatment of the plating bath with activated carbon would be necessary to remove the degradents. Of course, such as batch carbon treatment requires that the plating batn and production be shut down. Needless to say, in addition to wasted production time and reduced output of plated parts, labor costs are incurred in conducting the batch carbon treatment. Also, new coumarin must be added to the plating bath, and the cost of such new coumarin is by no means negligible.

It has been known to reduce the concentration of coumarin in order to reduce degradation products and thereby increase bath life, but such reduction in coumarin concentration is usually accompanied by a loss in leveling and makes the bath more sensitive to degradent build-up. Also, the use of various additives such as aldehydes (including formaldehyde and chloral hydrate), has been proposed to help overcome the undesirable effects of the coumarin degradation products. The use of such additives has, however, had certain limitations since even moderate concentrations of these materials not only increase the tensile stress of the nickel electrodeposits but also appreciably reduce the leveling action of the coumarin. It has further been proposed to overcome the difficulty encountered in using coumarin as an additive in nickel plating baths by including in the baths an ethylene oxide adduct of an acetylenic compound. Although this technique has been helpful in overcoming the problems encountered in the use of coumarin, its beneficial effects are relatively short-lived.

U.S. Pat. No. 3,719,568 and U.S. Pat. No. 3,795,592 describe improvements whereby the use of specific ether adducts of propargyl alcohol, including propylene oxide adducts and propane sultone adducts, extend the life of coumarin based baths. This means the resultant baths do not have to be treated as often for degradent formation. Baths so treated also maintain the desired properties longer. Butyne diol is also mentioned in these patents as an additional additive which helps to maintain desired leveling characteristics. While these abovementioned additives are indeed effective, such processes still have to be batch treated, using activated carbon, sometimes as often as every two or three weeks, depending on the nature of the installation. Further, while leveling is maintained at a higher degree than without these additives, such leveling still has a tendency to decrease with time, such that as the organic degradents build, the leveling still diminishes considerably.

It is also known that coumarin based processes normally provide poorer corrosion properties than other nickel processes. This is readily demonstrated in accelerated tests such as the conventional "CASS" and "Corrodkote" tests widely used in the plating arts. The use of additives such as aldehydes to increase corrosion resistance has only met with limited success. In addition to processes and plating baths having coumarin and various additives therein, similar efforts to develop suitable additives have been directed at oxyomegasulfohydrocarbon-di-yl coumarin, which in general does not produce leveled deposits when used alone, unless very high concentrations are used. Typical of plating processes and baths of the above-identified types, including both coumarin based and oxyomegasulfohydrocarbon-di-yl coumarin based processes and baths, are those described in United States Pat. Nos. 3,111,466; 3,367,854; 3,414,491; 3,556,959; 3,677,913; 3,719,568; and 3,795,592; to which reference is made for the further details of the processes, and the disclosures of which are incorporated by reference.

The present invention is believed to be applicable to coumarin based processes and baths of the foregoing type and is specifically directed to an improved process and bath which provides benefits and advantages heretofore unattainable with prior art practices. More particularly, it is a principle object of the present invention to provide a coumarin based process and electroplating bath which will run considerably longer than the processes described above, will sustain desired leveling characteristics, and will provide improved corrosion resistance.

SUMMARY OF THE INVENTION

In accordance with the present invention, it has unexpectedly been found that the life of coumarin based nickel baths can be greatly prolonged by utilizing a process which comprises electrodepositing nickel on a base using an aqueous acidic nickel electroplating bath comprising a coumarin compound and an aryl hydroxy carboxylic acid compound, such as salicyclic acid, present in a combined amount effective to provide a ductile, self-leveling nickel deposit. The usable aryl hydroxy carboxylic acid compounds include materials corresponding to the following general structural formula:

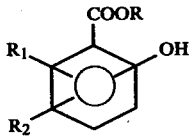

wherein:

R is —H, or M, wherein M is a bath soluble cation, $R_1$ is —H, —$CH_3$, —$C_2H_5$, —$OCH_3$, —$OC_2H_5$, or a halogen, $R_2$ is —H, —COOH, —$CH_3$, —$C_2H_5$, —$OCH_3$, —$OC_2H_5$, or a halogen, as well as mixtures thereof. In a preferred form, the bath may further include hexyne diol and/or a material selected from the group consisting of primary acetylenic alcohols and adducts of primary acetylenic alcohols, as well as mixtures thereof. It has been found that excellent leveling and physical properties can be maintained utilizing such a bath, while at the same time, the usual coumarin concentration level can be reduced significantly. In addition, additives such as butyne diol, and/or aldehydes such as formaldehyde and chloral hydrate may be utilized, which along with the materials referred to above, give still longer bath life.

It has also been found that corrosion resistance is dramatically improved, as evidence by conventionally used "CASS" tests. Coumarin compound concentrations in the range of from about 20 to about 150 mg/L are suitable for use with the present invention, with from about 50 to about 90 mg/L being preferred, and about 75 mg/L being typical. For the aryl hydroxy carboxylic acid compounds referred to above, concentrations in the range of from about 0.005 to about 1.5 g/L are suitable for use with the present invention, with from about 0.02 to about 0.2 g/L being preferred, and about 0.10 g/L being typical.

Additional benefits and advantages of the present invention will become apparent upon a reading of the detailed description of the preferred embodiments taken in conjunction with the accompanying examples.

DESCRIPTION OF THE PREFERRED EMBODIMENTS

In the practice of the present invention, the electroplating baths used are aqueous solutions containing one or more nickel salts. Typically, such baths may be prepared by dissolving nickel chloride and/or nickel sulfate and boric acid in water. Such baths are often referred to as conventional Watts nickel baths. Other nickel electroplating baths based on nickel sulfate, nickel chloride, nickel formate, nickel sulfamate, nickel fluoroborate, or the like, as well as a nickel salt dissolved in an aqueous acidic solvent, may also be used. Additionally, the electroplating baths of the present invention may also contain one or more cobalt salts, of the same or similar type as the nickel salts which have been referred to above.

With regard to the coumarin compounds suitable for use with the present invention, in addition to coumarin itself, (also known as benzopyrone, $C_9H_6O_2$, a lactone) which is the most preferred, various substituted coumarins such as 3-chlorocoumarin, 5-chlorocoumarin, 6-chlorocoumarin, 7-chlorocoumarin, 8-chlorocoumarin, 3-bromocoumarin, 5-bromocoumarin, 6-bromocoumarin, 7-bromocoumarin, 8-bromocoumarin, 3-acetylcoumarin, 5-methoxycoumarin, 6-methoxycoumarin, 7-methoxycoumarin, 8-methoxycoumarin, 5-ethoxycoumarin, 6-ethoxycoumarin, 7-ethoxycoumarin, 8-ethoxycoumarin, 3-methyl coumarin, 5-methyl coumarin, 6-methyl coumarin, 7-methyl coumarin, 8-methyl coumarin, 5,6-dimethyl coumarin, 5,7-dimethyl coumarin, 5,8-dimethyl coumarin, 6,7-dimethyl coumarin, 6,8-dimethyl coumarin, 7,8-dimethyl coumarin and the like may also be used. Oxyomegasulfohydrocarbon-di-yl coumarin compounds are also suitable. Typically the coumarin compounds are present in the electroplating baths in amounts within the range from about 20 to about 150 mg/L, with from about 50 to about 90 mg/L being preferred. As noted above, 75 mg/L is a typical amount.

With regard to the aryl hydroxy carboxylic acid compounds suitable for use with the present invention, salicyclic acid ($C_6H_4(OH)(COOH)$, also known as ortho-hydroxybenzoic acid) is a preferred material. In addition, other aryl hydroxy carboxylic acid compounds such as materials corresponding to the following general structural formula:

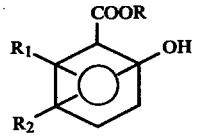

wherein:

R is —H, or M, wherein M is a bath soluble cation, $R_1$ is —H, —OH, —$CH_3$, —$C_2H_5$, —$OCH_3$, —$OC_2H_5$, or a halogen, $R_2$ is —H, —COOH, —$CH_3$, —$C_2H_5$, —$OCH_3$, —$OC_2H_5$, or a halogen, as well as mixtures thereof, may also be used. (As used herein, the term "aryl hydroxy carboxylic acid compound" is meant to include mixtures of such individual compounds.) In the above general structural formula, —OH, $R_1$, and $R_2$ may be positioned at any vertex of the benzene ring. Typically such materials are present in the electroplating baths in amounts within the range of from about 0.005 to about 1.5 g/L, with from about 0.02 to about 0.20 g/L being preferred, and about 0.10 g/L being typical. As to salicyclic acid, a preferred material, it may be present in the electroplating baths in amounts within the range of from about 0.005 to about 1.5 g/L, with from about 0.02 to about 0.15 g/L being preferred, and about 0.075 g/L being typical. Salicylic acid and its related aryl hydroxy carboxylic acid compounds as referred to above maintain or improve color and aid ductility and low stress. This is a surprising and unexpected result since the structure of these aryl hydroxy carboxylic acid compounds is similar to melilotic acid, the typical coumarin degradation product referred to above. It has been found that these compounds also suppress the degradation products of coumarin and actually keep the same from forming to some degree. Thus, since less coumarin is needed, the quantity of degradents is reduced. Furthermore, since the formation of degradents is suppressed, bath life is dramatically increased.

With regard to the use of hexyne diol with preferred forms of the electroplating bath of the present invention, hexyne diol may be present in an amount of from about 30 to about 150 mg/L, with from about 50 to 100 mg/L being preferred. 3-hexyne-2,5 diol is commercially available from BASF Wyandotte Corporation. In general, hexyne diol aids in leveling.

With regard to yet other materials usable with the present invention, and as noted above, the electroplating process and bath of the present invention may, in a preferred form, further include a material selected from the group consisting of primary acetylenic alcohols and adducts of primary acetylenic alcohols, as well as mixtures thereof, which may be present in an amount of from about 1 to about 30 mg/L, with from about 5 to about 15 mg/L being preferred. Such materials provide additional improvement in leveling, physical properties, and color, by further interacting with the other materials previously discussed. Such primary acetylenic alcohols may include a material selected from the group consisting of propargyl alcohols, methyl butynols, 1-butyne-3-ols, and materials corresponding to the following general structural formulas:

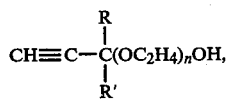

$$CH{\equiv}C-C(OC_2H_4)_nOH,$$

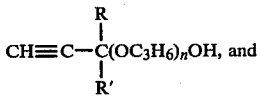

$$CH{\equiv}C-C(OC_3H_6)_nOH, \text{ and}$$

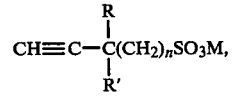

$$CH{\equiv}C-C(CH_2)_nSO_3M,$$

wherein n=1 to 4, R and R′ are H or $CH_3$, and M=a bath soluble cation; as well as mixtures thereof. The above-referenced adducts of primary acetylenic alcohols may include a material selected from the group consisting of ethylene oxide adducts of propargyl alcohol and propylene oxide adducts of propargyl alcohol, as well as mixtures thereof. Examples of such materials suitable for use herein include propargyl alcohol ethylene oxide (1-1 to 4-1 mole ratio), propargyl alcohol propylene oxide (1-1 to 4-1 mole ratio), methyl butynol ethylene oxide (1-1 to 4-1 mole ratio), or methyl butynol propylene oxide (1-1 to 4-1 mole ratio).

Among still other materials suitable for use with the process and bath of the present invention are butyne diol, and various aldehydes such as formaldehyde, chloral hydrate, glyoxal, piperonal, and benzaldehyde. These may be added as necessary in conventional amounts to further enhance bath performance and plating quality. Of course, other conventional commercially available brighteners and/or additives may also be used at the discretion of one skilled in the art.

It is to be noted, however, that although the amounts of the various components set forth above are typical of the amounts which may be used, this is not to say that amounts of these components which are outside of these ranges may not be used. Rather, it is intended that although for many typical operations of the process of the present invention these amounts have been found to be preferred, in many instances, amounts which are both greater than and less than those which have been specifically recited will also produce satisfactory results. In this regard it is to be appreciated that the specific amount of each of these additive components which is used will, of course, depend upon the particular amounts of the other components which are utilized.

In formulating an electroplating bath according to the present invention for use in the process of the present invention, a conventional aqueous acidic solution is formed containing the desired nickel or nickel and cobalt salts. Typically these electroplating baths will have a pH within the range of about 3 to about 4.5 and, depending upon the particular nickel salts used, will contain the nickel salts in amounts within the range of about 200 to about 400 g/L. Where cobalt salts are also present in the electroplating baths, these will typically be present in amounts within the range of about 10 to about 100 g/L, depending upon the particular salts used, as well as the amount of nickel salt which is present. The most preferred plating baths will also contain boric acid which is desirably present in amounts within the range of about 30 to about 60 g/L. Additionally, the other components are included in the electroplating bath in the amounts which have been indicated hereinabove.

In the operation of the process of the present invention, the electroplating solutions will typically be used at conventional temperatures, generally within the range of about 100 to about 150° F. In general, agitation of the solution, either by air agitation, cathode rod agitation, mechanical agitation, or the like, is preferred. Although with the electroplating baths of the present invention, semi-bright nickel electrodeposits are obtained over wide conventional current density ranges, e.g., generally about 2 to about 150 amps per square foot (ASF), the typical average current densities used in the operation of the present process are within the range of about 25 to about 50 ASF, with conventional plating times ranging generally from about 10 to about 60 minutes.

When operating in the above manner, excellent semi-bright, ductile deposits of nickel and nickel-alloys containing at least about 80 percent nickel are obtained, which electrodeposits have excellent leveling characteristics. Moreover, it is found that with the combined use of the various components and additives referred to above, degradent formation is significantly reduced and the adverse effects of the degradation products of coumarin are overcome. At the same time, the coumarin concentration can be reduced. Longer bath life results and excellent leveling and physical properties also result.

In order to further describe and illustrate the process and electroplating bath of the present invention, the following examples are provided. It will be understood that these examples are provided for illustrative purposes and are not intended to be limiting of the scope of the invention as herein described and as set forth in the subjoined claims.

EXAMPLE 1

For the purposes of this example and Table I hereinbelow, a conventional Watts nickel electroplating bath was prepared utilizing 315 g/L $NiSO_5.6H_2O$, 60 g/L $NiCl_2.6H_2O$, and 50 g/L $H_3BO_3$. (The amount of nickel chloride used was higher than what is normally used (about 30 to 50 g/L) in semi-bright nickel baths. This was purposefully done to intensify the adverse effect of the coumarin breakdown products.) 150 mg/L of coumarin was also added to the above bath. The pH of this bath was adjusted to about 4.1 and the temperature was maintained at about 130±5° F. This bath was electrolyzed for about 25 amp hours per liter to accumulate degradents so that it would thereby produce an unacceptable deposit. A series of 1¼ inch by 6 inch polished steel test panels were rolled at one end to provide an extreme low current density or recess area for test purposes. The above bath was then divided into 300 cc portions in a series of plating cells equipped with air agitation.

Various compounds as listed in Table I hereinbelow were added to the individual plating cells in the stated concentrations. The above-described test panels were then plated at about 40 ASF (amperes per square foot) for about 15 minutes. The temperature range was as set forth above and was maintained using a hot water bath. Results for various compounds tested, as well as for a control plating cell without any additive are given in Table I hereinbelow.

TABLE I

| Plating Cell No. | Compound | Concentration | Result |
|---|---|---|---|
| 1 | None (control) | — | Semi-bright, grainy deposit with fair leveling, poor ductility, and a dark recess area. |
| 2 | salicylic acid | 50 mg/L | Overall semi-bright, ductile deposit, with good leveling, and a grainy recess area. |
| 3 | salicylic acid | 100 mg/L | Same as No. 2 except with an improved recess area. |
| 4 | salicylic acid | 1 g/L | Same as No. 3 |
| 5 | 2,5-dihydroxy benzoic acid | 50 mg/L | Same as No. 2 |
| 6 | 2,5-dihydroxy benzoic acid | 100 mg/L | Same as No. 3 |
| 7 | 3,5-dihydroxy benzoic acid | 100 mg/L | Same as No. 3 |
| 8 | 3,5-dihydroxy benzoic acid | 200 mg/L | Overall semi-bright, ductile, with good leveling and a good recess area. |
| 9 | phthallic acid | 100 mg/L | Overall dark grainy, brittle deposit. |
| 10 | phthallic acid | 200 g/L | Same as No. 9 |
| 11 | L-tartaric acid | 100 mg/L | Semi-bright, grainy deposit with fair leveling, poor ductility, and a dark recess area. Slightly more lustrous high current density area. |
| 12 | L-tartaric acid | 200 mg/L | Same as No. 11 |
| 13 | o-hydroxy benzaldehyde | 150 mg/L | Same as No. 1 |
| 14 | benzaldehyde | 150 mg/L | Same as No. 1 |
| 15 | catechol | 200 mg/L | Very slightly better than No. 1 |
| 16 | 1,3,5-trihydroxy benzene | 150 mg/L | Same as No. 1 |
| 17 | 2,4,6-trihydroxy benzoic acid | 200 mg/L | Same as No. 1 |
| 18 | 5-chlorosalicylic acid | 125 mg/L | Same as No. 2 |
| 19 | 3-methylsalicylic acid | 125 mg/L | Same as No. 2 |
| 20 | methyl salicylate | 100 mg/L | Same as No. 3 |

EXAMPLE 2

A commercial coumarin nickel electroplating bath contained about 100 mg/L of coumarin and also an unknown amount of acetylenic alcohols, specifically propargyl alcohol ethylene oxide (1-1) and butyne diol. The bath also contained chloral hydrate and formaldehyde in a combined amount of about 150 mg/L total. The inorganic salt concentrations were as follows: about 77.5 g/L $Ni^{+3}$, about 11.25 g/L $Cl^{-}$, about 285.75 g/L $NiSO_4.6H_2O$, about 37.13 g/L $NiCl_2.6H_2O$, and about 42.00 g/L $H_3BO_3$. The pH was maintained at about 4.1. The "T.F. Index" or treatment factor was about 6.1, which indicated that the bath was in need of a batch carbon treatment.

A 400 cc sample of the above bath was set up in a plating cell equipped with air agitation and placed in a hot water bath to maintain the temperature at about 130° F. A 1¼ inch by 6 inch polished steel test panel was plated in the bath at about 40 ASF for about 20 minutes. The deposit was semi-bright with some high current density dullness. The panel exhibited cracking upon bending indicating that the deposit was very brittle.

EXAMPLE 3

50 mg/L of salicylic acid was added to another (fresh) sample of the solution described in Example 2 above, and the plating test repeated as also described above in Example 2. The resulting deposit was now overall semi-bright with some cracking along the panel edges after bending.

EXAMPLE 4

The procedure of Example 3 was repeated except with 100 mg/L of salicylic acid being added instead of 50 mg/L. The resulting deposit was now overall semi-bright to lustrous with no visible cracking after the panel was severely bent.

EXAMPLE 5

Each of four in-line semi-bright nickel plating baths used to plate automobile bumpers had a bath composition which was maintained to correspond generally to a conventional Watts nickel bath composition containing about 300 g/L $NiSO_4.6H_2O$, about 40 g/L $NiCl_2.6H_2O$, and about 50 g/L $H_3BO_3$. Each of the baths was also maintained to contain between about 150 to about 200 mg/L of coumarin, between about 15 to about 25 mg/L of butyne diol, between about 4 to about 6 mg/L of propargyl alcohol propylene oxide (1-1), and between about 50 to about 70 mg/L of chloral hydrate. Each of the baths was operated at a pH of about 3.8 and temperatures of from about 125° to about 135° F. Plating was done at about 40 to 50 ASF for about 30 to 35 minutes. Due to the use of auxiliary anodes and relatively extreme plating conditions, these baths had to be batch treated with activated carbon about every five days.

Even after only about three days operation, the subsequent semi-bright deposits became duller and less uniform. Ductility also was reduced from 0.5 (perfect) to about 0.1, and the internal stress increased from about 16,000 psi tensile to about 25,000 psi tensile.

One of the four semi-bright nickel baths referred to above was converted to a test bath wherein the composition was maintained to correspond to the same conventional Watts nickel bath composition as prior to the conversion, with the following additive levels being maintained: between about 50 to about 70 mg/L of hexyne diol, between about 20 to about 30 mg/L of butyne diol, between about 6 to about 9 mg/L of propargyl alcohol ethylene oxide (1-1), between about 25 to about 35 mg/L of chloral hydrate, between about 50 to about 70 mg/L of formaldehyde, between about 15 to about 135 mg/L of salicylic acid (sodium salt), and between about 50 to 100 mg/L of coumarin. (Generally, optimum results are obtained at about the midpoint of the above ranges.) In addition to the above-described operating conditions, the electrolyte, pH, and temperature of the converted bath remained unchanged. Prior to the conversion of the one bath, all four baths were batch treated with activated carbon to make all conditions as equal as possible. The "T.F. Index" values for the four baths after carbon filtration were all about 0.75.

During the test period which lasted about seven weeks, the following observations were made regarding the converted test bath:

(1) The ductility remained at 0.5.
(2) The internal stress went down from about 16,000 psi tensile to about 10,000 psi tensile.
(3) The color of the deposit remained semi-lustrous and was uniform over all current density ranges.
(4) The leveling remained equal to that obtained from coumarin baths immediately after carbon treatment even though the coumarin content was maintained at only about half that of the other three baths.
(5) The "T.F. Index" or treatment factor only rose to about 0.95.

The other three normal or control baths degraded as before, although not quite as rapidly as in previous runs. It is believed that this was due to the fact that some of the additive materials from the test bath were dragged into these three control baths since the test bath was the first of the four, and all work from this first test bath had to be carried over the other three before going into the subsequent conventional bright nickel plating bath. In spite of the positive effects from drag-in, each of the other three control baths had to be batch treated with activated carbon at least twice during the seven week test period. Within ten days after start up, the ductility of these three unconverted, control baths fell to 0.1, the internal stress increased to over 20,000 psi tensile, the color of the subsequent deposits became dull, and the "T.F. Index" values ranged from about 2.0 to about 3.5, with the lower treatment factor value being in the tank closest to the test bath.

EXAMPLE 6

Due to the success of the tests described in Example 5 hereinabove, the three normal or control baths (which were not converted in Example 5) were also converted to the test process, i.e., with the addition of the additives listed in Example 5 in connection with the converted test bath. All four baths were then found to operate problem free.

The first converted test bath of Example 5 was then changed to contain the converted test bath composition, except without salicylic acid. After about two weeks of operation, there was an observable reduction of deposit properties, plus a loss of appearance. At this juncture, about 50 mg/L of salicylic acid was added to this bath. There was a noticeable improvement in physical properties and appearance following the addition and the bath continued to improve with electrolysis and maintenance additions of salicylic acid.

EXAMPLE 7

A nickel electroplating bath was prepared as described in Example 1 hereinabove, except that in place of coumarin, 150 mg/L of 3-chlorocoumarin was added to the bath. The pH of this bath was adjusted to about 4.1 and the temperature was maintained at about 130°±5° F. This bath was then electrolyzed for about 25 amp hours per liter, with the 3-chlorocoumarin being replenished to maintain the above-specified concentration of 150 mg/L. Following this electrolysis, a 1½ inch by 6 inch rolled polished steel panel was plated at about 40 ASF for about 15 minutes. The resulting deposit was very grainy and dull, brittle, and had a lustrous recess area.

EXAMPLE 8

100 mg/L of salicylic acid was then added to the solution utilized in Example 7 (after plating) and the panel plating test was repeated. The resulting deposit was uniformly semi-bright and ductile.

EXAMPLE 9

Examples 7 and 8 were repeated using 8-methoxycoumarin in place of 3-chlorocoumarin. In each instance, plating test results were comparable to those obtained in the corresponding Examples 7 and 8.

EXAMPLE 10

Example 7 was repeated using 150 mg/l of sodium-7-oxyomegasulfopropyl coumarin in place of 3-chlorocoumarin. The plating deposit after electrolysis was overall non-uniform, dull semi-bright, with good ductility, and a dark recess. The addition of 100 mg/L of salicylic acid to this bath, and repeating the procedure of Example 8, produced a very uniform, semi-bright, ductile deposit with a good recess.

EXAMPLE 11

A conventional Watts type nickel bath was prepared utilizing 297.98 g/L $NiSO_4.6H_2O$, 51.08 g/L $NiCl_2.6H_2O$, and 40.5 g/L $H_3BO_3$. 150 mg/L of coumarin was added to the above described bath and the bath pH was adjusted to about 4.0. The solution was then split into two one-liter plating cells, identified as Cell A and Cell B, equipped with air agitation and heated to maintain a constant temperature of about 135° F. 100 mg/L of salicylic acid was added to Cell B, but not to Cell A. Both Cells A and B were electrolyzed for about 150 amp hours at about 40 ASF. During electrolysis the coumarin was replenished in both cells to maintain the above-specified concentration, but the salicylic acid was replenished in Cell B only. Replishment additions for the salicylic acid in Cell B were estimated.

Following electrolysis, which took several days, solution samples were analyzed using a liquid chromatograph to accurately identify the concentrations of coumarin, salicylic acid, and melilotic acid present in each cell. Results were as follows:

| | Cell A | Cell B |
|---|---|---|
| Coumarin | 0.085 g/L | 0.088 g/L |
| Salicylic Acid | None | 0.275 g/L |
| Melilotic Acid | 1.32 g/L | 0.66 g/L |

These above results indicate that during electrolysis the salicylic acid appreciably reduces the formation of melilotic acid, the typical coumarin degradation product.

EXAMPLE 12

Another conventional Watts type nickel bath was prepared utilizing 294.23 g/L $NiSO_4.6H_2O$, 58.58 g/L $NiCl_2.6H_2O$, and 40.43 g/L $H_3BO_3$. (This nickel chloride concentration is similar to that used in Example 1 hereinabove.) 100 mg/L of salicylic acid was also added to the above bath. The pH of this bath was adjusted to about 4.0 and the temperature was maintained at about 130° F. A one liter plating cell equipped with air agitation was used. A 1¼ inch by 6 inch rolled polished steel test panel was plated at about 30 ASF for about 20 minutes. The resulting panel had an overall smooth gray, ductile deposit with a lustrous recess. Then, 900 mg/L of salicylic acid was added to the above plating cell to bring the total salicylic acid concentration up to 1 g/L. Another 1¼ inch by 6 inch rolled polished steel test panel was plated at about 30 ASF for about 20 minutes. The pH and temperature were as before. The resulting panels from this bath with 1 g/L of salicylic acid had an overall gray, ductile deposit with a dark recess. These two plated panels show that salicylic acid by itself, that is, without coumarin, does not produce a satisfactory semi-bright nickel deposit. As should be noted from the other examples hereinabove, salicylic acid in combination with coumarin gives enhanced luster and overall appearance.

EXAMPLE 13

Additional aqueous acidic-nickel electroplating baths, comprising a coumarin compound and an aryl hydroxy carboxylic acid compound of the type described by the general structural formula for the same given above present in a combined amount effective to provide a ductile, self-leveling nickel deposit, are prepared. The baths contain a coumarin compound present in an amount of from about 20 to about 150 mg/L and also contain an aryl hydroxyl carboxylic acid compound present in an amount of from about 0.005 to about 1.5 g/L. Still additional baths are prepared which in addition to a coumarin compound and the above described aryl hydroxy carboxylic acid compounds further include hexyne diol, and/or a material selected from the group of primary acetylenic alcohols referred to and listed above, including materials corresponding to the general structural formulas for the same given above, and/or a material selected from the groups of adducts of primary acetylenic alcohols referred to and listed above, and/or mixtures of such primary acetylenic alcohols and adducts of primary acetylenic alcohols. When nickel is plated on substrates of the type referred to hereinabove, a ductile, self-leveling deposit will result. Less coumarin is needed, process life is increased, and corrosion resistance is improved.

As evidenced by the above examples, it should be apparent that the use of the process and electroplating bath of the present invention provides several advantages. A coumarin based system is provided which will run considerably longer than prior processes. In addition, degradient formation is reduced. Longer bath life results and excellent leveling and physical properties also result. "CASS" tests indicate improved corrosion resistance.

While it will be apparent that the invention herein disclosed is well calculated to achieve the benefits and advantages as hereinabove set forth, it will be appreciated that the invention is susceptible to modification, variation, and change without departing from the spirit thereof.

What is claimed is:

1. An aqueous acidic nickel electroplating bath comprising a coumarin compound and an aryl hydroxy carboxylic acid compound corresponding to the following general structural formula:

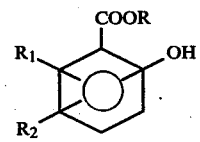

wherein:

R is —H, or M, wherein M is a bath soluble cation, $R_1$ is —H, —OH, $—CH_3$, $—C_2H_5$, $—OCH_3$, $—OC_2H_5$, or a halogen, $R_2$ is —H, —COOH, $—CH_3$, $—C_2H_5$, $—OCH_3$, $—OC_2H_5$, or a halogen, as well as mixtures thereof; present in a combined amount effective to provide a ductile, self-leveling semi-bright nickel deposit.

2. The electroplating bath as defined in claim 1 in which said bath further includes hexyne diol.

3. The electroplating bath as defined in claim 1 in which said bath further includes a material selected from the group consisting of primary acetylenic alcohols and adducts of primary acetylenic alcohols, as well as mixtures thereof.

4. The electroplating bath as defined in claim 3 in which said primary acetylenic alcohols include a material selected from the group consisting of propargyl alcohols, methyl butynols, 1-butyne-3-ols, and materials corresponding to the following general structural formulas:

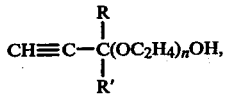

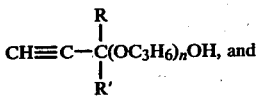

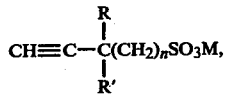

wherein n=1 to 4, R and R' are H or $CH_3$, and M=a bath soluble cation; as well as mixtures thereof.

5. The electroplating bath as defined in claim 3 in which said adducts of primary acetylenic alcohols include a material selected from the group consisting of ethylene oxide adducts of propargyl alcohol and propylene oxide adducts of propargyl alcohol, as well as mixtures thereof.

6. The electroplating bath as defined in claim 1 in which said bath further includes butyne diol.

7. The electroplating bath as defined in claim 1 in which said bath further includes chloral hydrate.

8. The electroplating bath as defined in claim 1 in which said bath further includes formaldehyde.

9. The electroplating bath as defined in claim 1 in which said coumarin compound is present in an amount of from about 20 to about 150 mg/L.

10. The electroplating bath as defined in claim 1 in which said coumarin compound is present in an amount of from about 50 to about 90 mg/L.

11. The electroplating bath as defined in claim 1 in which said coumarin compound is present in an amount of about 75 mg/L.

12. The electroplating bath as defined in claim 1 in which said aryl hydroxy carboxylic acid compound is present in an amount of from about 0.005 to about 1.5 g/L.

13. The electroplating bath as defined in claim 1 in which said aryl hydroxy carboxylic acid compound is present in an amount of from about 0.02 to about 0.2 g/L.

14. The electroplating bath as defined in claim 1 in which said aryl hydroxy carboxylic acid compound is present in an amount of about 0.10 g/L.

15. An aqueous acidic nickel electroplating bath comprising a coumarin compound and salicylic acid present in a combined amount effective to provide a ductile, self-leveling semi-bright nickel deposit.

16. The electroplating bath as defined in claim 15 in which said salicylic acid is present in an amount of from about 0.005 to about 1.5 g/L.

17. The electroplating bath as defined in claim 15 in which said salicylic acid is present in an amount of from about 0.02 to about 0.15 g/L.

18. The electroplating bath as defined in claim 15 in which said salicylic acid is present in an amount of about 0.075 g/L.

19. A process for producing nickel deposits which comprises electrodepositing nickel on a base using an electroplating bath comprising a coumarin compound and an aryl hydroxy carboxylic acid compound corresponding to the following general structural formula:

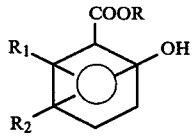

wherein:

R is —H, or M, wherein M is a bath soluble cation, $R_1$ is —H, —OH, $—CH_3$, $—C_2H_5$, $—OCH_3$, $—OC_2H_5$, or a halogen, $R_2$ is —H, —COOH, $—CH_3$, $—C_2H_5$, $—OCH_3$, $—OC_2H_5$, or a halogen, as well as mixtures thereof; present in a combined amount effective to provide a ductile, self-leveling semi-bright nickel deposit.

20. The process as defined in claim 19 in which said bath further includes hexyne diol.

21. The process as defined in claim 19 in which said bath further includes a material selected from the group consisting of primary acetylenic alcohols and adducts of primary acetylenic alcohols, as well as mixtures thereof.

22. The process as defined in claim 21 in which said primary acetylenic alcohols include a material selected from the group consisting of propargyl alcohols, methyl butynols, 1-butyne-3-ols, and materials corresponding to the following general structural formulas:

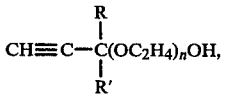

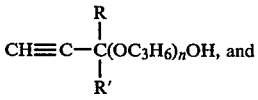

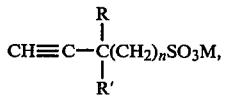

wherein n=1 to 4, R and R' and H or $CH_3$, and M=a bath soluble cation; as well as mixtures thereof.

23. The process as defined in claim 21 in which said adducts of primary acetylenic alcohols include a material selected from the group consisting of ethylene oxide adducts of propargyl alcohol and propylene oxide adducts of propargyl alcohol, as well as mixtures thereof.

24. The process as defined in claim 19 in which said bath further includes butyne diol.

25. The process as defined in claim 19 in which said bath further includes chloral hydrate.

26. The process as defined in claim 19 in which said bath further includes formaldehyde.

27. The process as defined in claim 19 in which said coumarin compound is present in an amount of from about 20 to about 150 mg/L.

28. The process as defined in claim 19 in which said coumarin compound is present in an amount of from about 50 to about 90 mg/L.

29. The process as defined in claim 19 in which said coumarin compound is present in an amount of about 75 mg/L.

30. The process as defined in claim 19 in which said aryl hydroxy carboxylic acid compound is present in an amount of from about 0.005 to about 1.5 g/L.

31. The process as defined in claim 19 in which said aryl hydroxy carboxylic acid compound is present in an amount of from about 0.02 to about 0.2 g/L.

32. The process as defined in claim 19 in which said aryl hydroxy carboxylic acid compound is present in an amount of about 0.10 g/L.

33. A process for producing nickel deposits which comprises electrodepositing nickel on a base using an electroplating bath comprising a coumarin compound and salicylic acid present in a combined amount effective to provide a ductile, self-leveling semi-bright nickel deposit.

34. The process as defined in claim 33 in which said salicylic acid is present in an amount of from about 0.005 to about 1.5 g/L.

35. The process as defined in claim 33 in which said salicylic acid is present in an amount of from about 0.02 to about 0.15 g/L.

36. The process as defined in claim 33 in which said salicylic acid is present in an amount of about 0.075 g/L.

* * * * *